US006231386B1

(12) United States Patent
Wu

(10) Patent No.: US 6,231,386 B1
(45) Date of Patent: May 15, 2001

(54) ELECTRICAL CONNECTOR WITH IMPROVED SOLDER PADS

(75) Inventor: Kun-Tsan Wu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/474,322

(22) Filed: Dec. 29, 1999

(51) Int. Cl.[7] ..... H01R 13/73
(52) U.S. Cl. ..... 439/570
(58) Field of Search ..... 439/570–572, 439/83

(56) References Cited

U.S. PATENT DOCUMENTS 5,096,440 * 3/1992 Katsumata ..... 439/570
5,186,654 * 2/1993 Enomoto et al. ..... 439/570
5,194,017 * 3/1993 Consoli ..... 439/570
5,232,379 * 8/1993 Lai ..... 439/570
5,297,966 * 3/1994 Brennian, Jr. et al. ..... 439/570
5,385,478 * 1/1995 Kiekawa ..... 439/570
5,591,047 * 1/1997 Yamada et al. ..... 439/570
5,704,807 * 1/1998 Sherman et al. ..... 439/570
6,007,352 * 12/1999 Azuma et al. ..... 439/570
6,012,949 * 1/2000 Lok ..... 439/570

* cited by examiner

*Primary Examiner*—Gary F. Paumen
(74) *Attorney, Agent, or Firm*—Wei Te Chung

(57) ABSTRACT

An electrical connector includes an insulative housing, a pair of contacts and a pair of L-shaped solder pads received in the insulative housing, respectively. The housing defines a pair of T-shaped channels spaced from each other in a bottom portion thereof. Each T-shaped channel includes a groove and a recess laterally exposing to the groove. Each L-shaped solder pad includes a first portion and a second portion being generally perpendicular to each other. A protrusion is embossed in a surface of the first portion of each solder pad. The first portions are assembled in the pair of T-shaped channels, respectively, and the protrusions are assembled in the pair of recesses, respectively. The second portions of the pair of L-shaped solder pads are soldered onto a circuit board, thereby retaining the electrical connector to the circuit board.

1 Claim, 4 Drawing Sheets

ELECTRICAL CONNECTOR WITH IMPROVED SOLDER PADS

BACKGROUND OF THE INVENTION

1. Field of the invention

The present invention relates to a connector, and particularly to a connector having a pair of improved solder pads for mounting the connector onto a circuit board by soldering the solder pads onto the circuit board by surface mounting technology (hereafter, SMT).

2. Description of the Prior Art

U.S. Pat. No. 5,186,654 discloses a conventional electrical connector 60 which is shown in FIG. 4. The connector 60 comprises an insulative housing 61, a plurality of contacts 62 received in the housing 61 and a pair of solder pads 63 for retaining the housing 61 together with the contacts 62 onto a circuit board 80 by soldering the solder pads 63 to the circuit board 80 by SMT. The housing 61 defines a pair of L-shaped channels 611 in two opposite lateral sides and communicating to a bottom side of the housing 61. Each solder pad 63 generally has a U-shape comprising a horizontal retention portion 631 and a horizontal mounting portion 633 connecting with each other via a vertical portion 632. The retention portion 631 is received in a horizontal section of the L-shaped channel 611 and the mounting portion 632 exposes beyond the L-shaped channel 611 to be soldered onto the circuit board 80 thereby retaining the housing 61 together with the contacts 62 onto the circuit board 80. The solder pad 63 has a simple configuration and can be manufactured at a low cost. The present invention discloses another configuration of such a solder pad that can be manufactured at a low cost, too.

BRIEF SUMMARY OF THE INVENTION

An object of the present invention is to provide an electrical connector having a pair of low costly manufactured solder pads for mounting the electrical connector onto a circuit board.

To fulfil the above object, an electrical connector of the present invention comprises an insulative housing, a pair of contacts and a pair of L-shaped solder pads received in the insulative housing, respectively. The housing defines a pair of T-shaped channels spaced from each other in a bottom portion thereof. Each T-shaped channel comprises a groove and a recess laterally exposing to the groove. Each L-shaped solder pad comprises a first portion and a second portion being generally perpendicular to each other. A protrusion is embossed in a surface of the first portion of each solder pad. The first portions are assembled in the pair of T-shaped channels, respectively, and the protrusions are assembled in the pair of recesses, respectively. The second portions of the pair of L-shaped solder pads are soldered onto a circuit board, thereby retaining the electrical connector to the circuit board.

Other objects, advantages and novel features of the invention will become more apparent from the following detailed description of the present embodiment when taken in conjunction with the accompanying drawings.

DETAILED DESCRIPTION OF THE INVENTION

Figure 1:
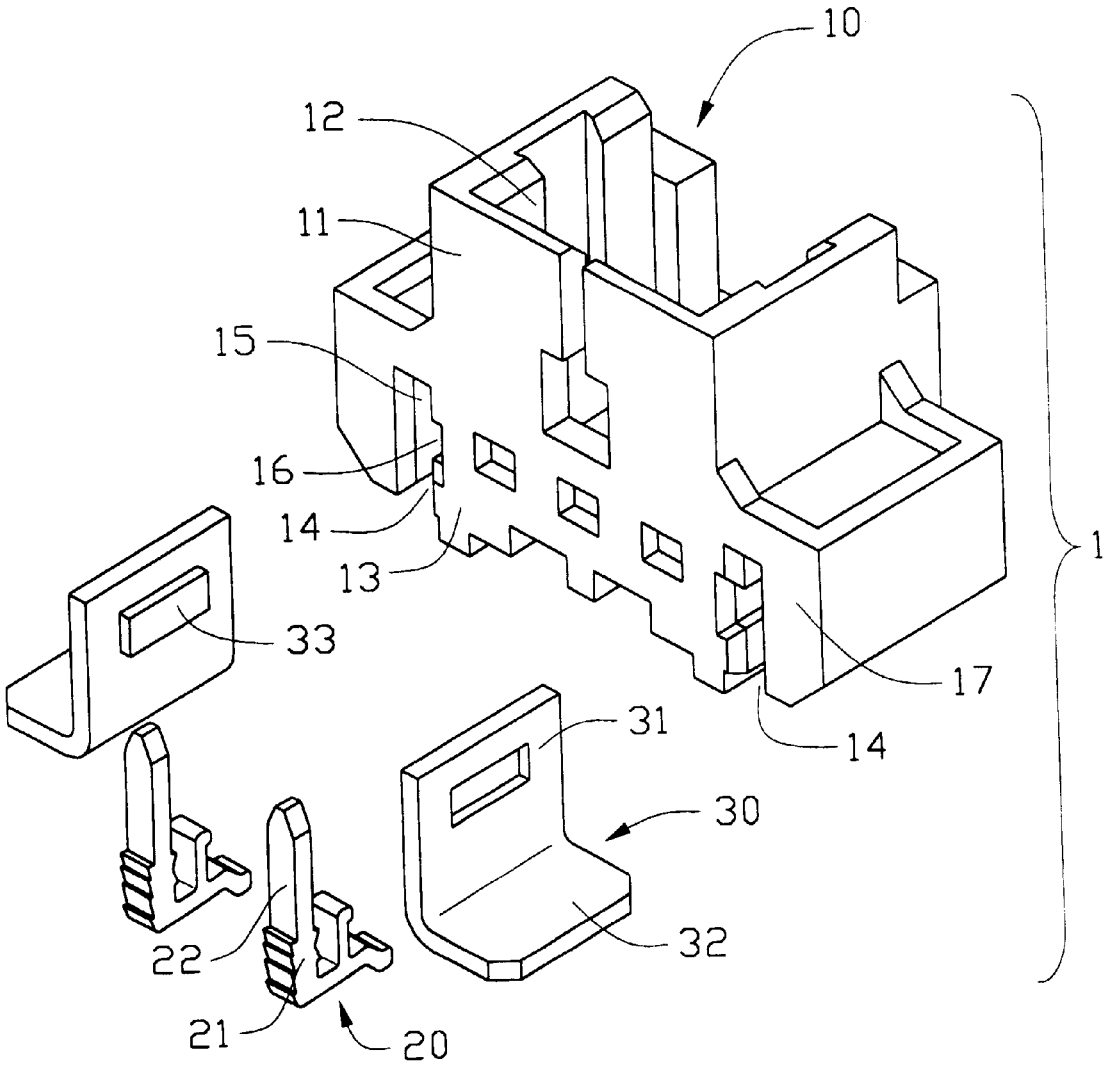
FIG. 1 is an exploded view of an electrical connector of the present invention.

Referring to FIG. 1, an electrical connector 1 of the present invention comprises an insulative housing 10, a pair of conductive contacts 20 secured in the housing 10 and a pair of solder pads 30 retained in the housing 10. The housing 10 defines a slot 12 in a top portion 11 thereof for accommodating a mating portion of a mating electrical connector (not shown). The housing 10 further defines a pair of cavities 18 (best seen in FIG. 3), which expose to the slot 12 of the top portion 11, in a bottom portion 13 thereof for receiving the pair of contacts 20 therein. The housing 10 also defines a pair of generally T-shaped channels 14 in the bottom portion 13 thereof beside the cavities 18. Each T-shaped channel 14 comprises a groove 15 exposing to a bottom face (not labeled) and a rear face 17 of the housing 10 and a recess 16 laterally exposing to the groove 15. Each contact 20 comprises a retention portion 21 and a mating portion 22. Each L-shaped solder pad 30 comprises a first portion 31 and a second portion 32 generally perpendicular to each other. A protrusion 33 is embossed in a surface of the first portion 31 of each solder pad 30.

Figure 2:
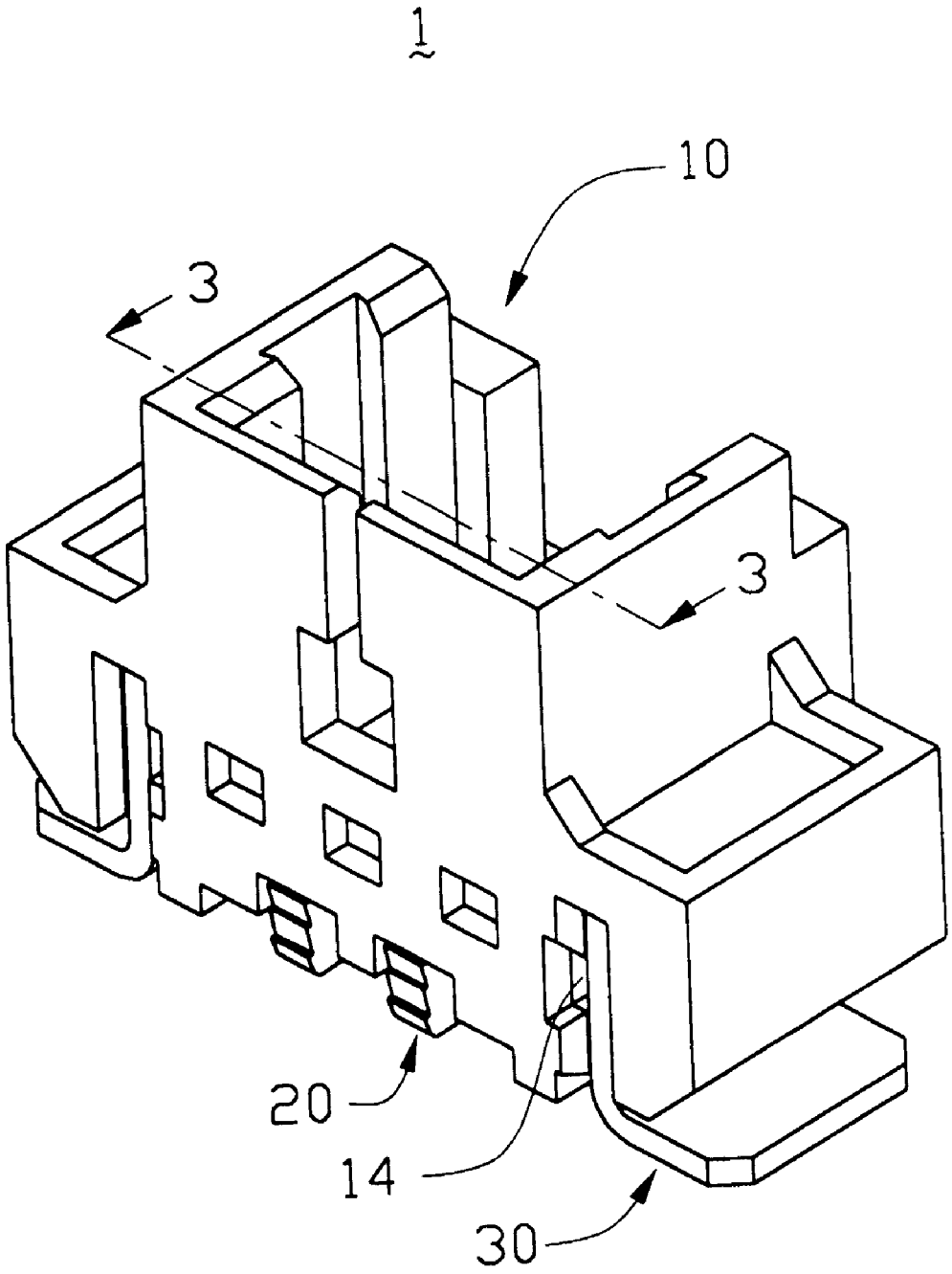
FIG. 2 is an assembled view of FIG. 1.
Figure 3:
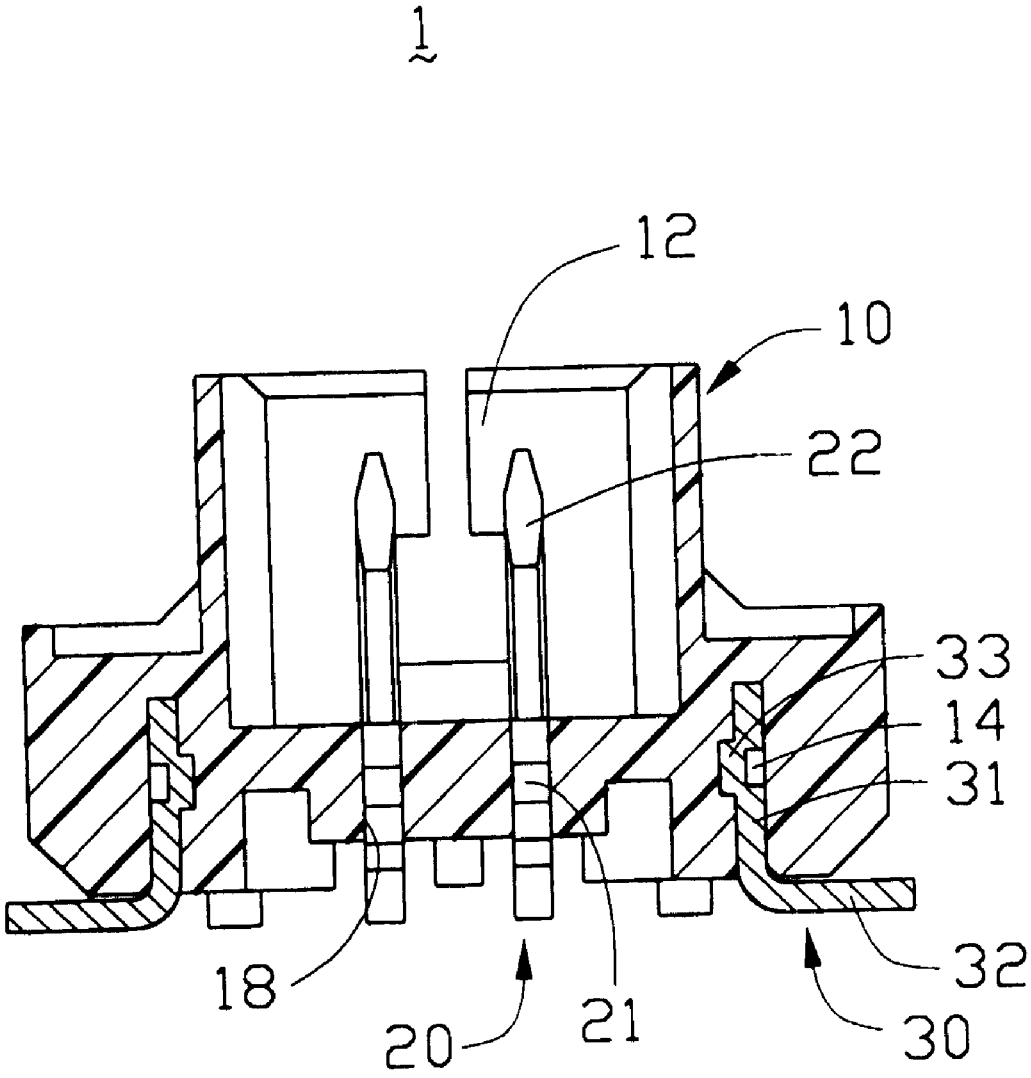
FIG. 3 is a cross-sectional view of the assembled connector taken along line 3—3 of FIG. 2.
Figure 4:
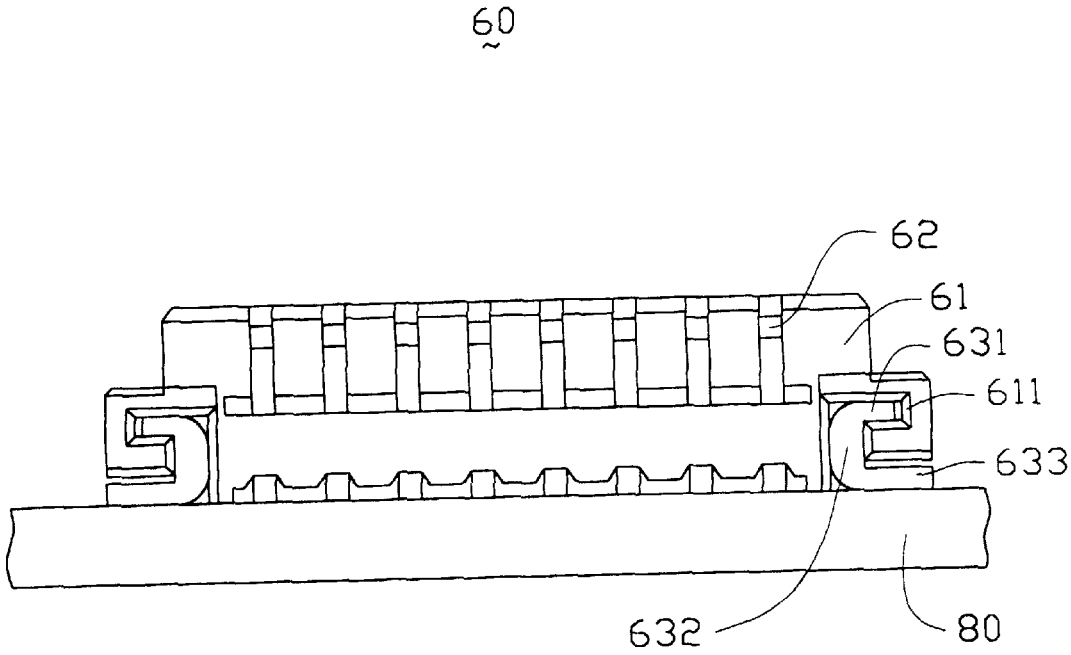
FIG. 4 (PRIOR ART)
FIG. 4 is a conventional electrical connector with a pair of conventional solder pads.

Also referring to FIGS. 2 and 3, in assembly, the pair of contacts 20 is upwardly assembled into the housing 10 with the mating portions 22 thereof exposing in the slot 12 of the housing 10 and the retention portions 21 interferentially received in the cavities 18. The solder pads 30 are assembled into the T-shaped channels 14 of the housing 10 from the rear face 17 to reach an assembled position wherein the first portion 31 of each solder pad 30 is received in groove 15 of the T-shaped channel 14, the protrusion 33 thereof is received in the recess 16 of the T-shaped channel 14, and the second portion 32 is located below the bottom face of the housing 10 and extends beyond a lateral side face of the housing 10. The second portions 32 of the solder pads 30 are then soldered onto a circuit board (not shown) by SMT, thereby securing the electrical connector 1 onto the circuit board.

In manufacture, the pair of T-shaped channel 14 is formed by conventional injection molding process, and the pair of solder pads is formed by stamping and embossing process, therefore, the cost of manufacture of the connector 1 is lower than the conventional connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing defining a pair of spaced apart T-shaped channels in a bottom portion thereof, each T-shaped channel comprising a groove and a recess laterally exposed to the groove;

a plurality of contacts received in the insulative housing; and a pair of L-shaped solder pads each comprising a first portion and a second portion generally perpendicular to each other, the first portion having a protrusion in a surface thereof; wherein the first portion is received within the respective groove and the protrusion is secured in the corresponding recess wherein the protrusion is embossed in the surface of the first portion;

restrictedly secured in an insulative housing of an electrical connector.

* * * * *